United States Patent [19]

LaLonde

[11] Patent Number: 4,967,439

[45] Date of Patent: Nov. 6, 1990

[54] DEVICE FOR CLEANING WIND MUSICAL INSTRUMENTS

[76] Inventor: Anthony F. LaLonde, 2469 Klein Rd., San Jose, Calif. 95148

[21] Appl. No.: 322,547

[22] Filed: Mar. 13, 1989

[51] Int. Cl.[5] ..... B08B 9/02; G10G 7/00

[52] U.S. Cl. ..... 15/104.10 R; 15/104.165; 15/210 R; 15/211; 15/231; 84/453

[58] Field of Search ..... 15/104.1 R, 104.165, 15/210 R, 211, 231; 84/453

[56] References Cited

U.S. PATENT DOCUMENTS

| | | | |
|---|---|---|---|
| 1,164,564 | 12/1915 | Yost | 15/104.165 |
| 1,421,529 | 7/1922 | Millhouse . | |
| 1,427,582 | 8/1922 | Cumpston . | |
| 2,637,865 | 5/1953 | Posson | 15/104.2 |
| 3,116,576 | 1/1964 | Block | 15/211 X |
| 3,151,517 | 10/1964 | Guinness | 84/230 |
| 3,488,790 | 1/1970 | Satoh | 15/118 |
| 3,739,420 | 6/1973 | Kafkis | 15/211 |
| 4,114,504 | 9/1978 | Koregelos | 84/453 |

FOREIGN PATENT DOCUMENTS

| | | | |
|---|---|---|---|
| 25415 | 8/1906 | Fed. Rep. of Germany . | |
| 29366 | 3/1907 | Fed. Rep. of Germany | 15/104.165 |
| 41611 | 10/1907 | Switzerland | 15/104.165 |
| 26650 | of 1910 | United Kingdom . | |

*Primary Examiner*—Edward L. Roberts
*Attorney, Agent, or Firm*—Jack M. Wiseman

[57] ABSTRACT

A device for cleaning an inner wall of a tube for a wind musical instrument. The device includes a semi-rigid rod formed of separable half sections, which define, when contiguous to one another, an axially directed slit. A removable cleaning cloth is secured within the slit between the confronting walls of the half sections of the rod, when the confronting walls of the half sections are contiguous to one another. The cloth extends along the rod in the axial direction substantially the entire distance of the rod, when the walls of the half sections are contiguous to one another.

5 Claims, 2 Drawing Sheets fig_1
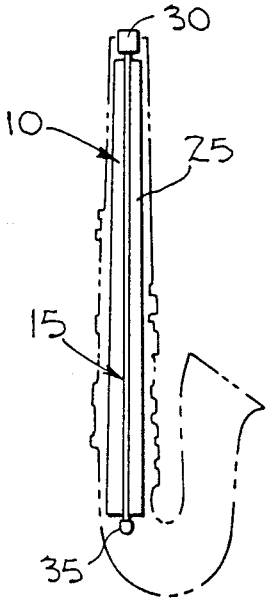
fig_2
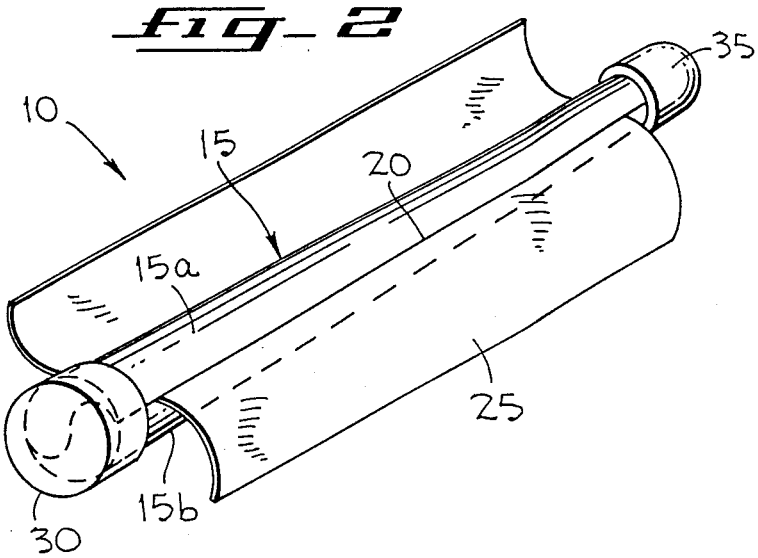
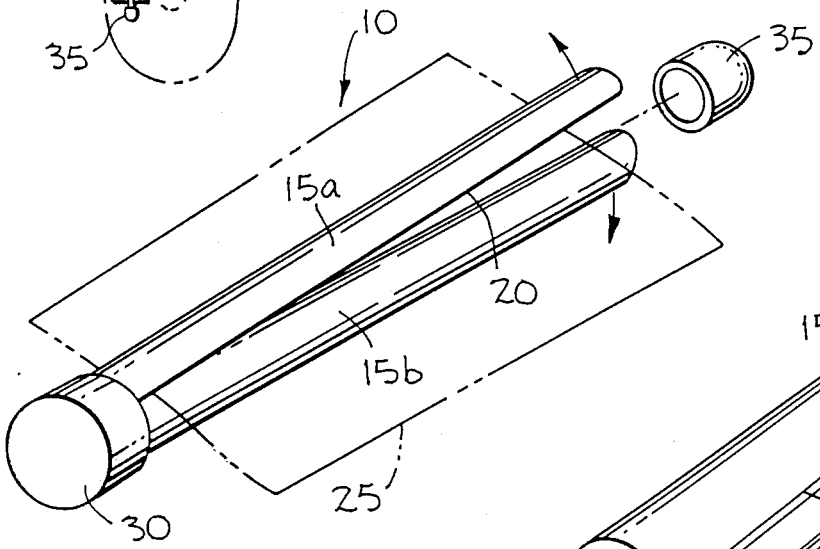
fig_3
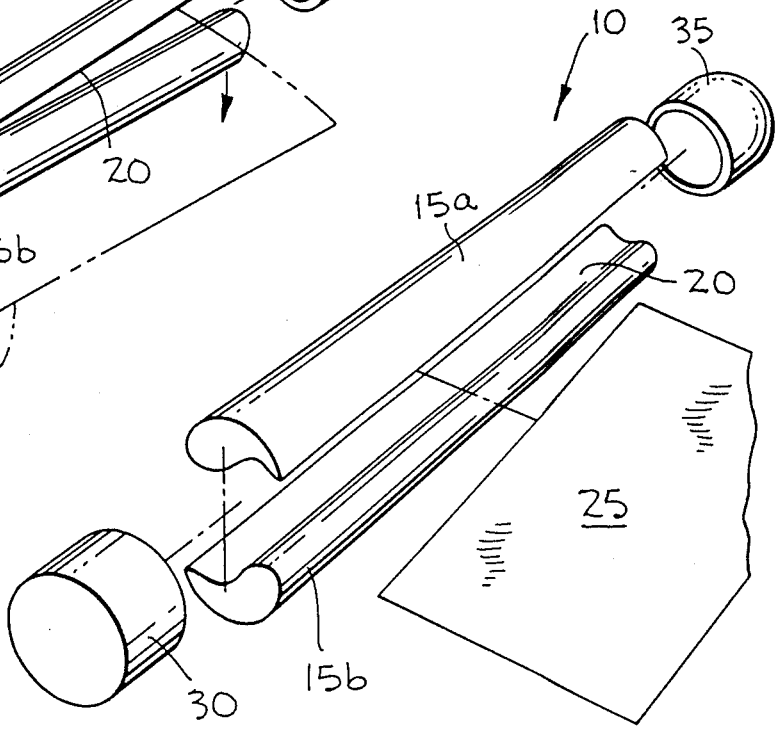
fig_4
fig_5
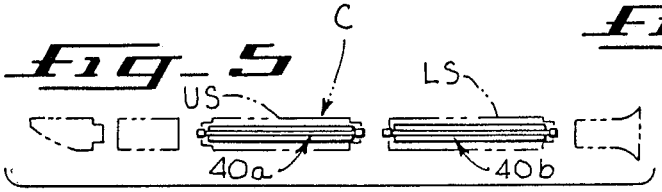
fig_6
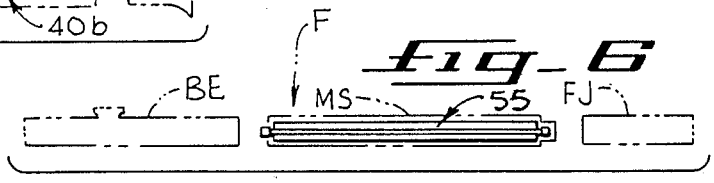

Fig_7
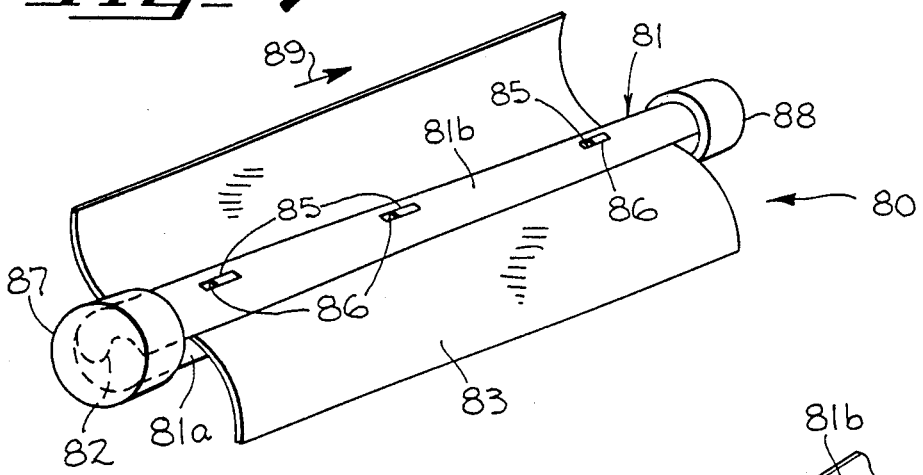
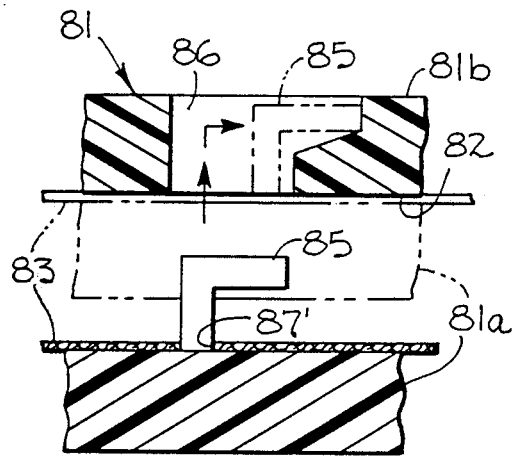
Fig_8
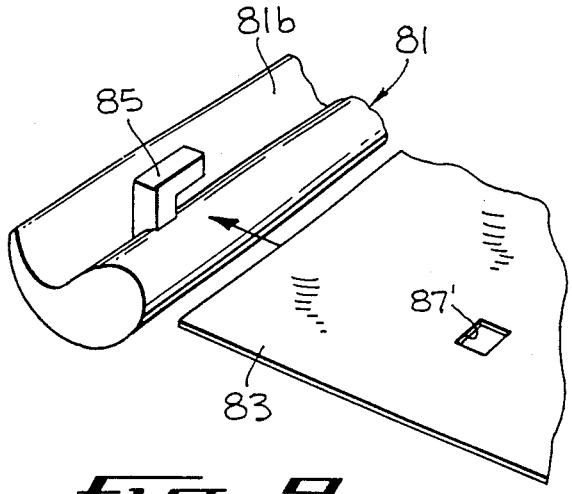
Fig_9
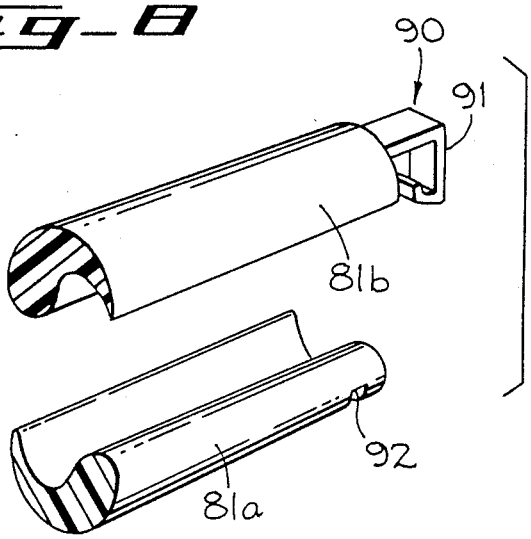
Fig_10
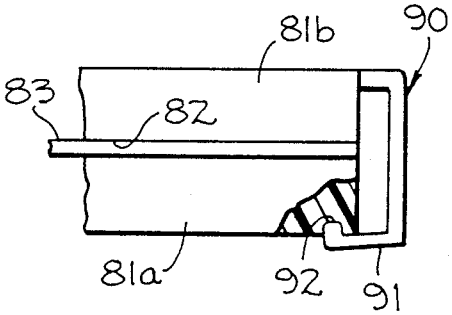
Fig_11

DEVICE FOR CLEANING WIND MUSICAL INSTRUMENTS

BACKGROUND OF THE INVENTION

The present invention relates in general to devices for cleaning musical instruments, and more particularly to a device for cleaning wind musical instruments.

The playing of wind musical instruments causes moisture to collect on the inner wall of the tube of the wind instrument. The breath of the instrumentalists condenses on the inner wall of the tube of the wind instrument. Proper care of the wind instrument requires the removal of the moisture from the inner wall of the tube of the wind instrument. Heretofore, cotton swabs have been employed to remove the moisture that has collected on the inner wall of the tube of the wind instrument. Such swabs were intended to be disposable after the first use and were, therefore, not intended to be washable and reusable after washing. Heretofore, bristles were employed to remove moisture that has collected on the inner wall of the tube of the wind instrument. The bristles with the moisture collected thereon extended through the tone holes of the musical instrument, resulting in moisture collecting on the pad that covers the tone holes. The repeated wetness of the pad causes the pad to become hard rather than remain a soft material.

The U.S. Pat. No. 4,114,504, to Koregelos, issued on Sept. 19, 1978, for Demoisturizer For Wind Musical Instrument, discloses an elongated device with filaments disposed along an elongated member. The filaments extend radially outward from the elongated member. The device is inserted into the tube of the wind instrument, whereby the filaments absorb moisture that has collected on the inner walls of the tube.

The U.S. Pat. No. 1,421,529, to Millhouse, issued on July 4, 1922, for Cleaning Device, discloses a cleaning device having an elongated resilient wire. At the free end of the elongated resilient wire is a bristle brush. The elongated wire is inserted into the tube of the wind instrument and the brush at the free end thereof removes the moisture from the inner wall of the tube of the wind musical instrument.

In the U.S. Pat. No. 3,488,790, to Satch, issued on Jan. 13, 1970, for Cleaning Rod For Woodwind Musical Instruments, there is disclosed a cleaning rod for musical instruments. At the free end of the rod is a hole through which a piece of cloth passes.

In the U.S. Pat. No. 3,739,420, to Kafkis, issued on June 19, 1973, for Device For Swabbing The Base of A Musical Instrument, there is disclosed a device for removing moisture from the inner wall of a tube of a wind musical instrument. The device includes a flexible cord. At the free end of the cord is a triangularly shaped body of foamed plastic material. On the foamed plastic body is a contour conforming chamois cloth.

The U.S. Pat. No. 3,151,517, to Guinness, issued on Oct. 6, 1964, for Musical Pipes, discloses a musical pipe made of telescoping tubes. The U.S. Pat. No. 2,637,865, to Posson, issued on May 12, 1953, for Tube Cleaning Tool, discloses a ramrod. At the free end of the ramroad is a cleaning swab.

The U.S. Pat. No. 1,427,582, to Cumpston, issued on Aug. 29, 1922, for Gun Cleaning Device, discloses a ramrod. At the free end of the ramrod is a tip with a slit. A cleaning rag is disposed on the slit of the tip and wrapped around the tip. A sleeve is slipped over the tip.

The unwrapped portion of the rag passes through a slit in the sleeve and the free end of the rag hangs loosely from the slit in the sleeve.

The British Patent No. 26,650, to Foster, issued Nov. 17, 1910, for An Improved Cleaning Device For The Barrels of Firearms and For Other Tubes, discloses a cylindrical rod slotted diametrically at the free end thereof. A flannel cloth is inserted into the slot. The cloth is wrapped around the rod and presents a cylindrical surface.

The German Patent No. 25415, to Glatz, issued on Aug. 25, 1906, discloses a rod with a tip at one end.

SUMMARY OF THE INVENTION

A device for cleaning an inner wall of a tube of a wind musical instrument, which includes an elongated member having an axially directed slit disposed along substantially the length of the elongated member and across the cross-sectional area of the elongated member. Disposed in the slit is a cleaning cloth that extends substantially along the entire length of the slit. By separating the elongated member along the length thereof, the cleaning cloth can be removed from or inserted between sections of the elongated member. By placing the separated sections of the elongated member into contiguous relation, the cloth is removably secured in the slit between the sections of the elongated member. A cap is disposed on at least one end of the elongated member to retain the cloth securely between the sections of the elongated member. The cloth, while retained securely between the sections of the elongated member, projects radially outward from the elongated member and along the length of the elongated member.

An object of the present invention is to provide a device for cleaning an inner wall of a tube of a wind instrument in which a cleaning cloth extends substantially along the entire length of an elongated member and is removably secured between separable sections of the elongated member.

A feature of the present invention is that the cleaning cloth can be removed with facility from the device for washing and reuse after being washed.

Another feature of the present invention is to provide abrasive confronting surfaces on the separable sections of the elongated member gripping the cleaning cloth for improving the gripping action between the elongated member and the cleaning cloth.

Another object of the present invention is to provide a device for cleaning an inner wall of a tube of a wind instrument in which the moisture collecting element or elements do not extend through the tone holes of the instrument.

A feature of the present invention is that the cleaning cloth does not extend through the tone holes of the instrument to obviate the problem of moisture collecting on the pad covering the tone holes.

BRIEF DESCRIPTION OF THE DRAWINGS

FIG. 1 is a front elevation view of a cleaning device embodying the present invention and illustrated with a tenor saxophone shown in dotted line.

FIG. 2 is a perspective view of the cleaning device shown in FIG. 1 dimensioned for use with a tenor saxophone.

FIG. 3 is a diagrammatic perspective view of the cleaning device shown in FIGS. 1 and 2 with sections of an elongated member of the cleaning device separated for inserting between and removing from the separable sections a cleaning cloth of the cleaning device.

FIG. 4 is an exploded perspective view of the cleaning device shown in FIGS. 1–3.

FIG. 5 is an exploded side elevation view of cleaning devices embodying the present invention illustrated for use with a clarinet.

FIG. 6 is an exploded side elevation view of a cleaning device embodying the present invention illustrated for use with a flute.

FIG. 7 is a perspective view of a modification of the cleaning device shown in FIGS. 1–4 and particularly illustrating a locking arrangement for the separable sections of the elongated member.

FIG. 8 is an enlarged, fragmentary, diagrammatic axial vertical section of the arrangement shown in FIG. 7 for locking the separable sections of the elongated member illustrated with separable sections spaced one above the other.

FIG. 9 is a fragmentary, exploded perspective view of the arrangement shown in FIGS. 7 and 8 for locking the separable sections of the elongated member illustrating one of the separable sections and the cleaning cloth.

FIG. 10 is a fragmentary, exploded perspective view of an arrangement for latching one end of the separable sections of the elongated member.

FIG. 11 is a fragmentary, elevation view of the arrangement shown in FIG. 10 for latching one end of the separable sections of the elongated member.

DESCRIPTION OF THE PREFERRED EMBODIMENTS

Illustrated in FIGS. 1–4 is a device 10 for cleaning the inner wall of a tube of a wind musical instrument, such as a saxophone, flute and clarinet. The device 10 comprises an elongated, semi-rigid member 15 made of suitable material. In the preferred embodiment, the member 15 is made of aluminum. The length of the elongated member is suitable for extending along a substantial portion of an inner wall of a tube of a wind musical instrument, such as a tenor saxophone (FIGS. 1, 2 and 7).

The elongated member 15 is formed with an axially directed slit or slot 20 extending substantially along the entire length of the elongated member 15. In the preferred embodiment, the slit 20 extends along the entire length of the elongated member 15 to form sections 15*a* and 15*b* that are entirely separable. The confronting walls of the separable sections 15*a* and 15*b* have complementary sinuous configurations (FIGS. 2 and 4). The complementary sinuous-shaped walls extend across an entire cross-sectional area of the elongated member 15 to be in effect diametral (FIG. 4). The complementary sinuous-shaped walls for the separable sections 15*a* and 15*b* serve to provide a more effective closure for releasably securing therebetween a cleaning cloth 25. In the preferred embodiment, the amplitudes of the complementary sinuous-shaped walls are equal and the center axis of the complementary sinous-shaped walls is a diametral.

In the exemplary embodiment, the cleaning cloth 25 is made of a synthetic chamois or felt material. The cleaning cloth 25 extends substantially along the entire length of the elongated member 15 and gradually increases in transverse dimension from one end to the other when used as a cleaning cloth for a saxophone (FIGS. 2 and 7). When used to remove moisture from the inner wall of a tube of a wind musical instrument, the cleaning cloth 25 is removably secured between the separable sections 15*a* and 15*b* and extends generally along the entire length of the elongated member 15.

In the preferred embodiment, the confronting sinuous-shaped walls of the separable sections 15*a* and 15*b* are coated with a suitable abrasive material to improve the--gripping engagement e ween the cleaning cloth 25 and the separable sections 15*a* and 15*b*. In the exemplary embodiment, the abrasive coating is formed by applying a 3M SUPER 77 spray adhesive to the confronting sinuous-shaped walls of the separable sections 15*a* and 15*b*.

For removing the cloth 25 from the slit 20 or for inserting the cloth 25 between the separable sections 15*a* and 15*b*, the separable sections 15*a* and 15*b* are angularly spaced apart (FIG. 3). For removably securing the cloth 25 between the separable sections 15*a* and 15*b*, the confronting sinuous walls of the separable sections 15*a* and 15*b* are moved into a contiguous, interlocking arrangement with the cleaning cloth 25 therebetween (FIG. 2).

At one end of the elongated member 15 is a cap 30, which, in the exemplary embodiment, is made of rubber or a suitable plastic. The cap 30 continuously remains in place and serves as an enlarged section to facilitate the gripping and the removal of the device 10 when the device 10 is disposed in the tube of the wind instrument. When the slit 20 extends along the entire length of the elongated member 15, the cap 30 holds the adjacent ends of the separable sections 15*a* and 15*b* in the interlocking relation.

At the opposite end of the elongated member 15 is a removable cap 35. In the exemplary embodiment, the cap 35 is made of rubber or a suitable plastic. The cap 35 is removed from the elongated member 15, when the separable sections 15*a* and 15*b* are to be angularly spaced apart for the removal of the cleaning cloth 25 from the slit 20 or for the insertion of the cleaning cloth 25 between the separable sections 15*a* and 15*b* for gripping relation therewith.

The cloth 25, when used for cleaning a saxophone, has its longer transverse dimension adjacent the cap 35 and its shorter transverse dimension adjacent the cap 30. When the cleaning cloth 25 is releasably secured between the separable sections 15*a* and 15*b*, the free sides or flaps of the cleaning cloth 25 project radially outward from the elongated member 15.

In using the device 10 for cleaning the inner wall of a tube of a wind musical instrument, the cap 35 is inserted into the tube of the instrument while gradually rotating the elongated member 15. The cloth 25 rotates with the rotation of the elongated member 15 and the flaps of the cloth become furled about the elongated member 15 (FIG. 2) to prevent the elongated member 15 from contacting or scratching the inner wall of the tube of the instrument. The cap 30 remains accessible for gripping by an operator. The device 10 may remain in the tube until the instrument is to be used. The cloth 25 may be removed from the device 10 for washing and later reused.

Illustrated in FIG. 5 are cleaning devices 40*a* and 40*b* suitable for use in cleaning a clarinet C. They differ from the cleaning device 10 in the length of elongated members 45, the dimensions of cleaning cloths 50 and caps 70 are substantially the same size as caps 75. The devices 40*a* and 40*b* for cleaning the clarinet C have shorter elongated members 45 and the cleaning cloths 50 have smaller dimensions. The transverse dimensions of the cleaning cloths 50 are substantially equal throughout the length of the cleaning cloths 50. In using the devices 40a and 40b for cleaning the clarinet C, the clarinet C is separated axially along the length thereof so that an upper section US of the clarinet is separated from the lower section LS of the clarinet. The device 40a is disposed within the upper section US of the clarinet and the device 40b is disposed in the lower section LS of the clarinet in the manner described for the cleaning device 10. Illustrated in FIG. 6 is a cleaning device 55 suitable for use in cleaning a flute F. It differs from the cleaning device 10 in that an elongated member 60 is shorter and a cleaning cloth 65 is smaller in dimensions. The cleaning cloth 65 is rectangular in configuration. The caps 70 and 75 are substantially identical in size. The cap 75 is not configured to facilitate the gripping thereof by an operator. In using the cleaning device 55 for cleaning the flute F, the flute F is separated axially along the length thereof so that a main section MS is separated from the foot joint FJ and the blowing end BE. The device 55 is disposed within the main section MS in the manner heretofore described for the cleaning device 10.

Illustrated in FIGS. 7–9 is a device 80 for cleaning the inner wall of a tube of a wind musical instrument. The device 80 comprises an elongated, semi-rigid member 81 made of suitable material. In the preferred embodiment, the member 81 is made of plastic. The elongated member 81 is of a length suitable for extending along a substantial portion of an inner wall of a tube of a wind musical instrument, such as saxophone, clarinet and flute.

The elongated member 81 is formed with an axially directed slit or slot 82 that extends substantially along the entire length of the elongated member 81. In the preferred embodiment, the slit 82 extends along the entire length of the elongated member 81 to form separable sections 81a and 81b that are entirely separable. The confronting walls of the separable sections 81a and 81b have complementary sinuous configurations (FIG. 10). The complementary sinuous-shaped walls extend across an entire cross-sectional area of the elongated member 81 to be in effect diametral. The complementary sinuous-shaped walls for the separable sections 81a and 81b serve to provide a more effective closure for releasably securing therebetween a cleaning cloth 83. In the preferred embodiment, the amplitudes of the complementary sinuous-shaped walls are equal and the center axis of the complementary sinuous-shaped walls is a diametral. In the exemplary embodiment, the cleaning cloth 83 is made of a synthetic chamois or felt material.

Fixed to the sinuous-shaped wall of the separable section 81a is a plurality of axially aligned and spaced apart latches 85 (FIGS. 7–9). In the preferred embodiment, each latch 85 has an inverted L-shape. Formed in the sinuous-shaped wall of the separable section 81b is a plurality of axially aligned and spaced apart notches 86 for receiving respectively the latches 85 (FIGS. 7 and 8). The latches 85 interlock with the walls surrounding the notches 86, when the notches 86 receive the latches 85 and the separable section 81b is moved in the axial direction for interlocking engagement (FIG. 8).

The cleaning cloth 83 is formed with aligned, spaced apart openings 87' midway between the sides thereof (only one opening 87' shown in FIG. 9). The holes 87' receive successively the arms and then the legs of the latches 85, respectively. The cleaning cloth 83 extends substantially along the entire length of the elongated member 81 and, in the exemplary embodiment, gradually increases in transverse dimension from one end to the other when used as a cleaning cloth for a saxophone. When used as a cleaning cloth for a flute or clarinet, the transverse dimension of the cleaning cloth is the same from one end to the other. When used to remove moisture from the inner wall of a tube of a wind musical instrument, the cleaning cloth 83 is removably secured between the separable sections 81a and 81b generally along the entire length of the elongated member 81.

For removing the cloth 83 from the slit 82 or for inserting the cloth 83 between the separable sections 81a and 81b, the separable sections 81a and 81b are spaced apart by removing the latches 85 from the notches 86, respectively. To removably secure the cloth 83 between the separable sections 81a and 81b, the openings 87' of the cloth 83 receive the arms of the latches 85 and then the cloth 83 is moved along the arms of the latches 85 and subsequently along the legs of the latches 85. Now, the confronting walls of the separable sections 81a and 81b are moved together into a contiguous interlocking arrangement with the cleaning cloth 83 after inserting the latches 85 into the notches 86, respectively, and moving the separable section 81b into interlocking engagement.

In order to remove the cleaning cloth 83 from the slit 82, the separable section 81b is moved out of interlocking engagement and the latches 85 are removed from the notches 86, respectively. The separable sections 81a and 81b are spaced apart throughout the length of the elongated member 81. The cleaning cloth 83 is now removed from the latches 86. The cleaning cloth 83 can now be washed and reused after washing. The cleaning cloth 83 is removably secured between the separable sections 81a and 81b in the manner above described.

At one end of the elongated member 81 is a suitable tapered cap 87, which removably secures together the one end of the elongated member 81, when the sinuous-shaped walls of the separable sections 81a and 81b are contiguous to one another. The cap 87 may be made of suitable material, such as rubber or plastic. At the opposite end of the elongated member 81 is a removable tapered cap 88, which is made of suitable material, such as rubber or plastic. The cap 88 removably secures together the other end of the elongated member 81, when the sinuous-shaped walls of the separable sections 81a and 81b are contiguous to one another. When the separable sections 81a and 81b are to be separated and spaced apart, the caps 87 and 88 are removed from the opposite ends of the elongated member 81.

To move the separable sections 81a and 81b into interlocking engagement, after the latches 85 are received respectively by the notches 86, the separable section 81a is moved in the direction of an arrow 89 (FIG. 7) relative to the separable section 81b. To move the separable sections 81a and 81b out of interlocking engagement for the removal of the latches 85 from the notches 86, the separable section 81a is moved in a direction opposite to the direction of the arrow 89 relative to the separable section 81b before the latches 85 are removed from the notches 86, respectively. The caps 87 and 88 are removed from the opposite ends of the elongated member 81 before the separable sections 81a and 81b are moved out of interlocking engagement. The caps 87 and 88 are removably secured to the opposite ends of the elongated member 81 after the separable sections are disposed in interlocking engagement.

The cloth 83, when used for cleaning a saxophone, has its longer transverse dimension adjacent the cap 88 and its shorter transverse dimension adjacent the cap 87. When the cleaning cloth 83 is releasably secured between the separable sections 81*a* and 81*b*, the free sides or flaps of the cleaning cloth 83 project radially outward from the elongated member 81.

In using the device 80 for cleaning the inner wall of a tube of a wind musical instrument, the cap 88 is inserted into the tube while gradually rotating the elongated member 81. The cloth 83 rotates with the rotation of the elongated member 81 and the flaps of the cloth 83 become furled about the elongated member 81 (FIG. 7) to prevent the elongated member 81 from contacting or scratching the inner wall of the tube of the instrument. The cap 87, which is larger in size than the cap 88, remains accessible for gripping by an operator. The device 10 may remain in the tube until the instrument is to be used. The cloth 83 may be removed from the device 80 for washing and later reused after washing. The device 80 may be adapted for use with flutes or clarinets by making the elongated member 81 shorter or a suitable dimension. In so doing, the cloth 83 may have a rectangular configuration and the cap 88 may be of the same dimensions as the cap 87.

In a modification of the device 80, the cap 88 may be replaced by a latching arrangement 90 (FIGS. 10 and 11). The latching arrangement 90 comprises a resilient latch arm 91 that is fixed to the separable section 81*b* at the proximal end thereof. The distal end of the latch arm 91 includes a detent that is removably received by a notch 92 formed in the separable section 81*a*. The latch arrangement 90 removably secures together the adjacent ends of the separable sections 81*a* and 81*b* when the detent of the latch arm 91 is seated in the notch 92. When the detent of the latch arm 91 is removed from the notch 92, the adjacent ends of the separable sections 81*a* and 81*b* can be spaced from one another.

What is claimed is:

1. A cleaning device for cleaning a tube of a wind musical instrument comprising:

(a) an elongated member having separable sections separable from one another along the axis of said elongated member, said separable sections confronting one another in the axial direction of said elongated member and defining therebetween a slit axially directed along the axis of said elongated member when said separable sections are disposed in contiguous relation;

(b) a cleaning cloth removably secured between said separable sections and disposed within said axially directed slit, said cloth having at least one flap extending out of said slit for cleaning the tube of the wind musical instrument; and (c) means for releasably securing said separable sections in contiguous relation comprising a cap removably disposed on one end of said elongated member when said separable sections are disposed in contiguous relation, said cap being removed forms aid one end of said elongated member enabling said separable sections to be angularly displaced from one another for the removal of said cloth from said slit and for the insertion of said cloth between said separable sections for securement between said separable sections when said separable sections are disposed in contiguous relation.

2. A cleaning device as claimed in claim 1, wherein another cap is removably disposed on another end of said elongated member when said separable sections ar disposed in contiguous relation, said other cap being insertable into the tube of the wind musical instrument for said cleaning device to clean said tube and said one cap remaining accessible for gripping by an operator when said device is inserted into said tube for cleaning said tube, said one cap having larger dimensions than said other cap.

3. A cleaning device for cleaning a tube of a wind musical instrument comprising:

(a) an elongated member having separable sections separable from one another along the axis of said elongated member, said separable sections confronting one another in the axial direction of said elongated member and defining therebetween a slit axially directed along the axis of said elongated member when said separable sections are disposed in contiguous relation;

(b) a cleaning cloth removably secured between said separable sections and disposed within said axially directed slit, said cleaning cloth having at least one flap extending out of said lit for cleaning the tube of the wind musical instrument; and (c) means for releasably securing said separable sections in contiguous relation, (d) said separable sections being formed with complementary sinous-shaped confronting walls between which said cloth is removably secured when said separable sections are disposed in contiguous relation.

4. A cleaning device for cleaning a tube of a wind musical instrument comprising:

(a) an elongated member having separable sections separable from one another along the axis of said elongated member, said separable sections confronting one another in the axial direction of said elongated member and defining therebetween a slit axially directed along the axis of said elongated member when said separable sections are disposed in contiguous relation;

(b) a cleaning cloth removably secured between said separable sections and disposed within said axially directed slit, said cleaning cloth having at least one flap extending out of said slit for cleaning the tube of the wind musical instrument; and (c) means for releasably securing said separable sections in contiguous relation, (d) said separable sections being formed with confronting walls between which said cloth is removably secured when said separable sections are disposed in contiguous relation, said means for releasably securing said separable sections in contiguous relation comprising a plurality of latches extending from one of said contiguous walls, and a plurality of axially spaced notches formed in another of said confronting walls, said separable sections being in interlocking engagement when said latches are received by said notches, respectively.

5. A cleaning device as claimed in claim 4, wherein said cloth is formed with a plurality of axially spaced openings for receiving respectively said latches extending from said one contiguous wall for removably securing said cloth between said separable members when said separable sections are disposed in interlocking engagement.

* * * * *

UNITED STATES PATENT AND TRADEMARK OFFICE

CERTIFICATE OF CORRECTION

PATENT NO. : 4,967,439

DATED : November 6, 1990

INVENTOR(S) : ANTHONY F. LALONDE

It is certified that error appears in the above-identified patent and that said Letters Patent is hereby corrected as shown below:

Column 4, line 7, change "e ween" to ---between --;

Column 7, line 61, (claim 1) change "Forms aid" to -- From said---;

Column 8, line 29, (claim 3), change "sinous-shaped" to ---sinuous-shaped---.

Signed and Sealed this

Twenty-sixth Day of January, 1993

*Attest:*

STEPHEN G. KUNIN

*Attesting Officer*

*Acting Commissioner of Patents and Trademarks*